US005307570A

United States Patent [19]

Brown

[11] Patent Number: 5,307,570

[45] Date of Patent: May 3, 1994

[54] DAMPING DEVICE FOR DIRT SCRAPERS

[76] Inventor: Dennis Brown, Rte. 2, Box 2171, Dexter, Mo. 63841

[21] Appl. No.: 50,539

[22] Filed: Apr. 20, 1993

[51] Int. Cl.[5] ..... E02F 3/64

[52] U.S. Cl. ..... 37/439; 37/417; 37/907

[58] Field of Search ..... 37/131, 129, 124, 122, 37/118 R, DIG. 12, DIG. 20, 270, 271; 405/271; 404/76, 85, 86

[56] References Cited

U.S. PATENT DOCUMENTS

| | | | |
|---|---|---|---|
| 3,378,084 | 4/1968 | Ulrich | 37/270 X |
| 3,432,948 | 3/1969 | Myers | 37/270 |
| 3,464,129 | 9/1969 | Bogenschutz | 37/270 X |
| 3,872,612 | 3/1975 | Gee | 37/129 X |
| 3,889,404 | 6/1975 | Eftefield | 37/129 X |
| 4,125,950 | 11/1978 | Mashford | 37/271 |
| 4,343,101 | 8/1982 | Klekamp et al. | 37/129 |
| 4,389,800 | 6/1983 | Goby | 37/129 X |
| 5,185,946 | 2/1993 | Farrell | 37/270 X |

*Primary Examiner*—Dennis L. Taylor
*Assistant Examiner*—J. Russell McBee

[57] ABSTRACT

A damping device for use with a conventional dirt bucket on a dirt mover which includes a skid shoe hingedly attachable to the bucket by means of a hinge at the front end of the skid shoe, the skid shoe having a wear plate attached to the bottom. The skid shoe with wear plate attached is attachable to the back of the bucket by a spring loaded leg removably connected to an outer sleeve which substantially encloses the spring loaded leg and which is rigidly attachable to the back of the bucket.

10 Claims, 3 Drawing Sheets

DAMPING DEVICE FOR DIRT SCRAPERS

Field Of The Invention

This invention relates to an improved damping device for dirt scrapers and is particularly concerned with a spring-loaded device comprised of easily replaceable components.

BACKGROUND OF THE INVENTION

Dirt scrapers are mechanical devices used in dirt removal and land leveling operations. Dirt scrapers with large buckets for collecting scraped dirt include a cutting edge on the front of the bucket, hydraulic means for elevating and rotating the bucket when filled with dirt for transporting the dirt to another location and hydraulic means for tilting the bucket to empty the dirt contents and thereafter leveling the dirt.

A condition identified as "bounce" has long been a problem in dirt scraping operations, particularly when loading dirt scrapers, transporting the dirt scrapers with filled buckets of dirt, dumping the contents from the buckets and returning the empty scrapers to the original site. The term "bounce" includes the tendency of the cutting edge of the bucket to dig too deep or too shallow when collecting and removing a slice of dirt from the area being worked. Bounce also includes the concept of excessive vibration of the bucket during filling and transportation. Also, bounce may occur when one portion of the bucket cutting edge reaches the material being collected slightly ahead of the other edge portions of the bucket producing a horizontal bouncing effect from the bucket jumping back and forth from one side to the other in a somewhat uncontrollable manner. This bouncing effect presently can be corrected only when the pulling vehicle is slowed down to a crawl or after sufficient dirt is accumulated in the bucket to hold it down. Also, the bounce problem is compounded when the empty dirt scraper is returned for another leveling operation and has to go over the rough ground created by the uneven slices from previous loadings. The bounce problem is compounded and multiplied by the number of dirt scraping rigs utilized on a particular leveling job.

It has been previously proposed to mount solid skid shoes on the lower forward portion of the bucket near the cutting edge of the bucket. This reduced bucket bounce but did not eliminate the problem. Also, skid shoes have been mounted external of the bucket by attaching them to the front frame section of the dirt scraper. Skid shoes have even been attached to the towing tongue of the dirt scraper. Some skid shoes have been adjustable by means of bolts and it is also known to adjust the pitch of skid shoes by means of hydraulic assist.

U.S. Pat. No. 5,058,294 discloses a mobile excavating system having a continuous bucket series mounted at the leading end of a structural mainframe which includes a mold board/skid plate assembly which may be raised or lowered to hold at or near a particular grade elevation desired. The skid plate is used as a stabilizer for the digging wheel and the mold board blade. The skid plate is positioned against the mold board blade cutting edge and is held in position by means of compression springs and hydraulic damping cylinders. Such an arrangement is complicated, does not work effectively and is replaced only with great difficulty U.S. Pat No. 4,389,800 discloses land leveling scrapers having skid shoes whose bottom surfaces are free to accommodate and follow irregularities in the ground surface being leveled. The skid shoes are urged against the ground surface with a force proportional to the load on the bucket or the scraper by means of a complicated mechanical arrangement. Again, it must be noted that such arrangement would be difficult to install and maintain.

The problems associated with known prior devices are overcome by the present invention which is characterized by a damping device comprised of a spring loaded skid shoe with protected, easily replaceable parts.

SUMMARY OF THE INVENTION

This invention is an improved damping device for dirt scrapers having a spring loaded skid shoe and characterized by replaceable components held in loose alignment. The skid shoes have easily replaceable wear plates which provide a minimum amount of friction and drag on the skid shoes and therefore reduces drag-related power loss from the pulling vehicle. This invention essentially eliminates "bucket bounce", provides for faster loading, saves pressure on the vehicle operator, minimizes bouncing on return to reload and thus increases overall yardage scraped and moved from on location to another. This invention also prevents the bucket from sucking under and digging too deep on a pass.

More specifically, this invention includes a dirt scraper with a bounce damping device with spring loaded skid shoes wherein the skid shoes have replaceable wear plates attached thereto. Each skid shoe is mounted on the underside of the scraper bucket by means of a front hinge. Additionally, each skid shoe is hingedly attached to an upper leg arrangement by means of a rear hinge. The upper leg is comprised of a lower sleeve and an upper sleeve adapted to hold in place a coil compression spring adapted to compress and extend to maintain the skid shoe in working relationship with the ground.

Preferably, the lower sleeve has a female projection which mates with a male projection on the upper sleeve to increase the ability to maintain the upper leg in alignment during operation. The entire upper leg arrangement is adapted to fit inside an outer sleeve which is mounted on the upwardly curving rear portion of the bucket in angled relationship with the skid shoe, in removable relationship therewith. The skid shoe and the entire upper leg assembly are held in working relationship to each other by means of pin and key arrangements. Each and every component of the skid shoe and upper leg assembly can be easily and quickly removed and replaced as it becomes worn and inoperable without replacing the entire damping device arrangement. A particularly unique feature is the fact that the compression spring which is the major working component may be easily and quickly replaced in a matter of a very few minutes.

Description Of The Preferred Embodiment Of The Invention

With reference to the drawings, like numbers will be used to describe like parts in FIGS. 1–6.

Figure 1:
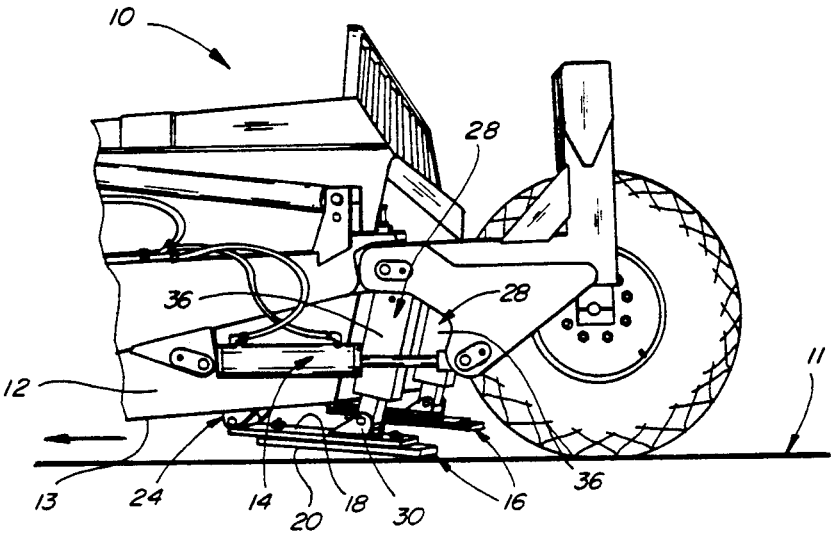
FIG. 1 is a side elevation perspective of a dirt scraper and the damping device of this invention.

FIG. 1 shows a portion of a conventional dirt scraper 10 with a conventional bucket 12 controlled by a conventional hydraulic system 14 for raising, lowering and tilting bucket 12.

Figure 3:
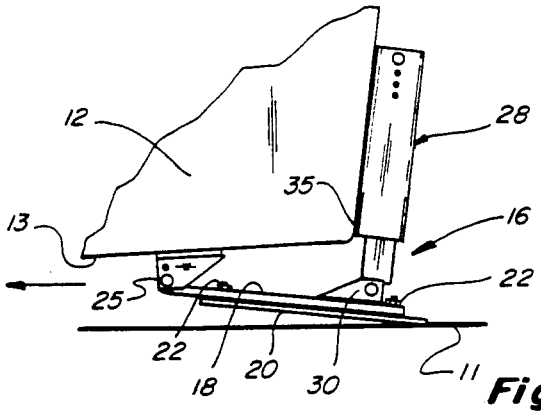
FIG. 3 is a partial view of the damping device of this invention with the skid shoe touching the dirt surface.
Figure 2:
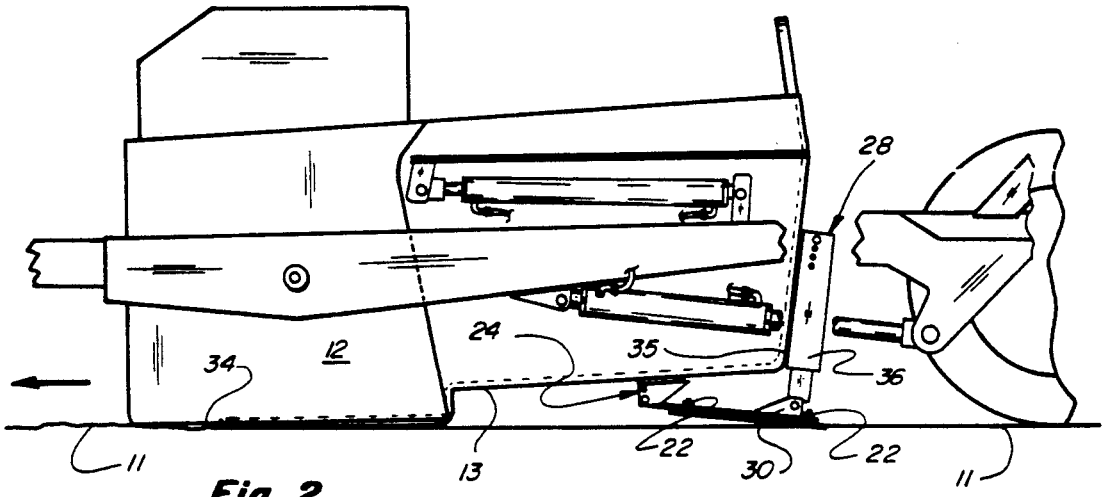
FIG. 2 is a side elevational view of a dirt scraper with a bucket in cutting position with the damping device of this invention.
Figure 4:
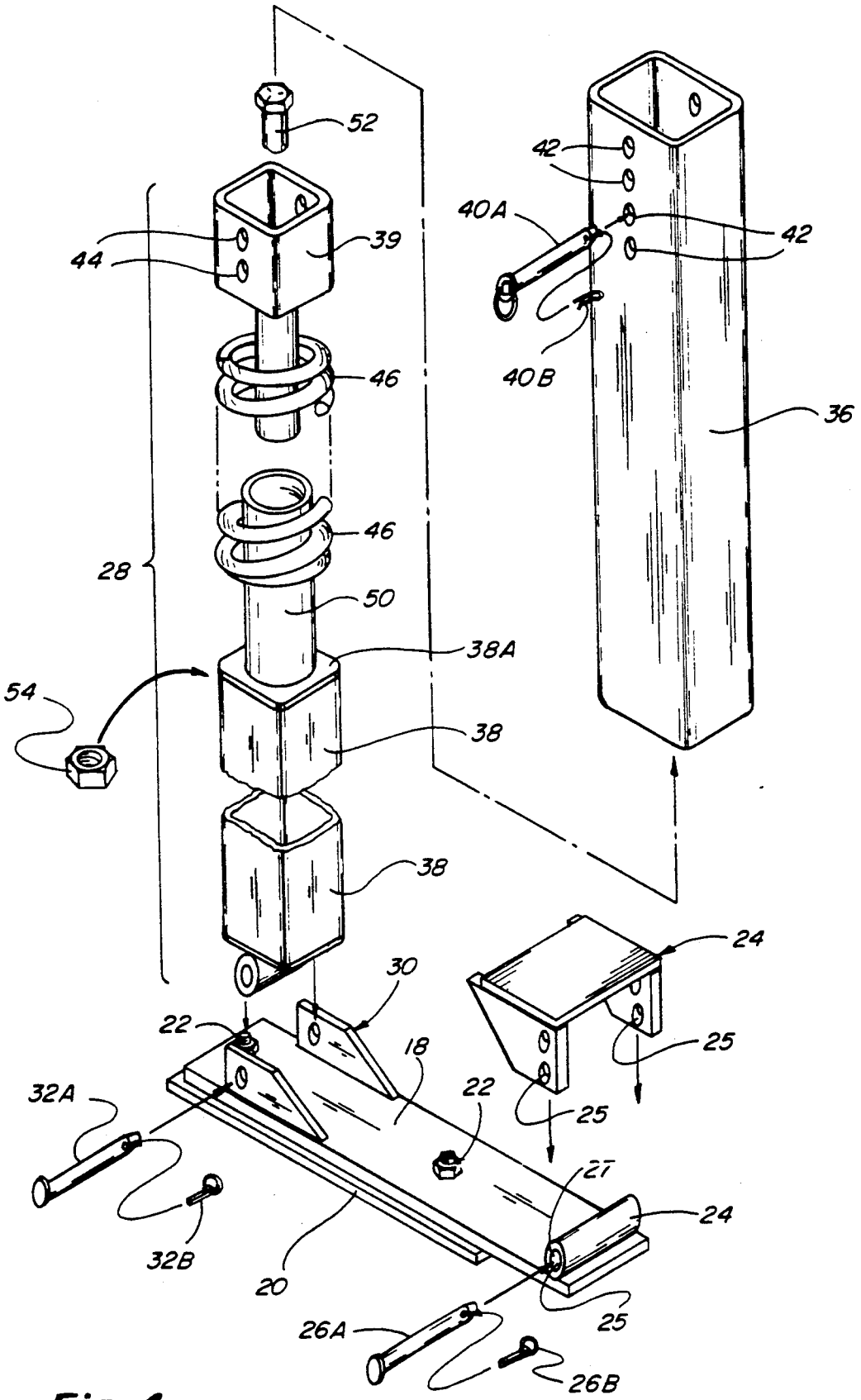
FIG. 4 is an exploded perspective view of the damping device of this invention.

A plurality of damping devices 16 are shown attached or welded to scaper bucket 12. Damping device 16 of this invention includes skid shoe 18 with wear plate 20 replaceably attached to the bottom of skid shoe 18. Wear plate 20 may be attached to skid shoe 18 by means of bolts 22 as best shown in FIGS. 2, 3 and 4. However, other means of attachment such as spot welding may be employed in the practice of this invention.

Skid shoe 18 of damping device 16 is attached to front hinge 24 which is welded to the bottom 13 of bucket 12 as best shown in FIGS. 2 and 3. Skid shoe 18 and front hinge 24 are preferably held together by inserting front pin 26A through hinge openings 25 and tubular portion 27 attached to skid shoe 18 and securing pin 26A by means of key 26B as best shown in FIG. 4. Other conventional hinging devices may be used in this invention but use of front pin 26A and key 26B is adapted for quick and easy removal of skid shoe 18 which preferably may be removed to replace wear plate 20. Wear plate 20 may be tapered at the front in order to more easily slide across dirt surface 11.

Skid shoe 18 is attached to upper leg arrangement 28, which contains coil spring 46, by means of rear hinge 30 located on skid shoe 18 behind front hinge 24. Rear hinge 30 is preferably held in place by rear pin 32A and key 32B, best shown in FIG. 4. Although other conventional hinge arrangements may be employed, use of rear pin 32A and key 32B is adapted for very rapid disengagement of leg 28 from skid shoe 18 for quick replacement of parts.

FIGS. 2 and 3 show damping device 16 secured in place at the rear portion of bucket 12 with cutting edge 34 in contact with dirt surface 11 ready for scraping and loading. Upper leg 28 is hingedly attached to skid shoe 18 and outer sleeve 36 is attached to the rear portion of scraper bucket 12 on the upward curving rear bucket surface 35, by welding, use of bolts or any other method for permanent attachment. In this configuration, damping device 16 is oriented at the rear of scraper bucket 12 so that wear plate 20 contacts dirt surface 11 as scraper 10 is pulled over the dirt. Upper leg assembly 28 is adjustably secured to outer sleeve 36 so that bucket 12 is maintained in a relatively level orientation which dampens the bounce commonly encountered on such dirt scrapers. Coil spring 46 incorporated in upper leg assembly 28, shown in FIG. 4, further acts to dampen the excessive vibration experienced in the scraping operation and maintains bucket 12 in a preferred level position. Replaceable wear plate 20 is in constant contact with surface 11 and is prone to significant wear. Skid shoe 18 and upper leg 28 are attached to each other and to bucket 12 by means of easily removable pin and key means to enable the easy replacement of worn out components.

Figure 5:
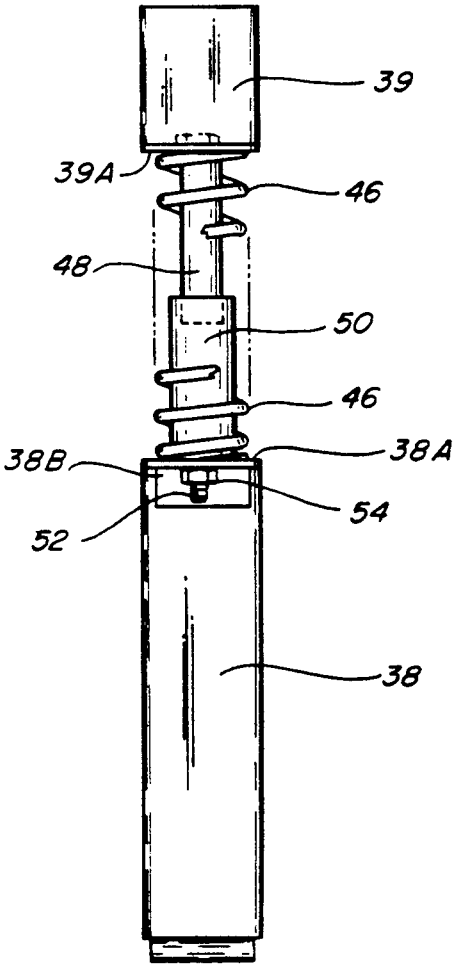
FIG. 5 is a rear view of the leg assembly lower inner sleeve and the upper inner sleeve held in alignment by female and male projections in a telescoping relationship; and, FIG. 6 is an exploded rear view of the leg assembly as shown in FIG. 5.

Leg 28 and its component parts is best shown in FIG. 4. Leg 28 includes lower inner sleeve 38 which is attached t and projects upward from rear hinge 30 and is generally hollow to save weight without sacrificing strength. Lower inner sleeve 38 includes a closed top 38A with access opening 38B as best shown in FIG. 5. Projecting upward from to 38A is female projection 50 attached to top 38A of lower inner sleeve 38. Compression spring 46 surrounds female projection 50 and projects upward where it abuts against upper inner sleeve 39. Upper inner sleeve 39 includes a lower closed portion with male projection 48 attached thereto. The top of spring 46 abuts bottom 39A of upper inner sleeve 39 and surrounds male projection 48 which is adapted to mate with female projection 50 when spring 46 is compressed in service. Leg assembly 28 is held in fixed alignment by means of bolt 52 and nut 54, as shown in FIG. 5.

Lower inner sleeve 38 is preferably rectangular in shape but may be any configuration but must be adapted to work in telescoping relationship with outer sleeve 36. Outer sleeve 36 is somewhat larger in cross section than lower inner sleeve 38 and upper inner sleeve 39 in order to make removal easy and to allow some play in operation. Lower inner sleeve 38 and upper inner sleeve 39 are removably held in place by means of upper pin 40A which projects through outer sleeve openings 42 and upper inner sleeve openings 44 in mating relationship and secured by key 40B. Also, preferably lower inner sleeve 38 and upper inner sleeve 39 and outer sleeve 36 rather loosely telescope together which provides somewhat less rigidity in damping device 16 which results in longer wear and fewer replacement of parts.

Leg 28 includes lower inner sleeve 38 and compression spring 46 which is preferably held in place as shown in FIG. 5. Male projection 48 and female projection 50 are adapted to work in mating relationship as spring 46 is compressed and expanded in operation. Other means for maintaining spring 46 in functional working relationship may be employed. Spring 46 may be held in place between lower inner portion 39A of upper inner sleeve 39 and closed top 38A of lower inner sleeve 38 by means of bolt 52 and nut 54 which is secured to upper inner sleeve 39 at one end and adapted to project through lower inner sleeve 38 at the other end. Leg 28 components remain aligned although spring 46 may be compressed during operation of damping device 16 and maintained in place when spring 46 is in a relaxed, expanded position.

Figure 6:
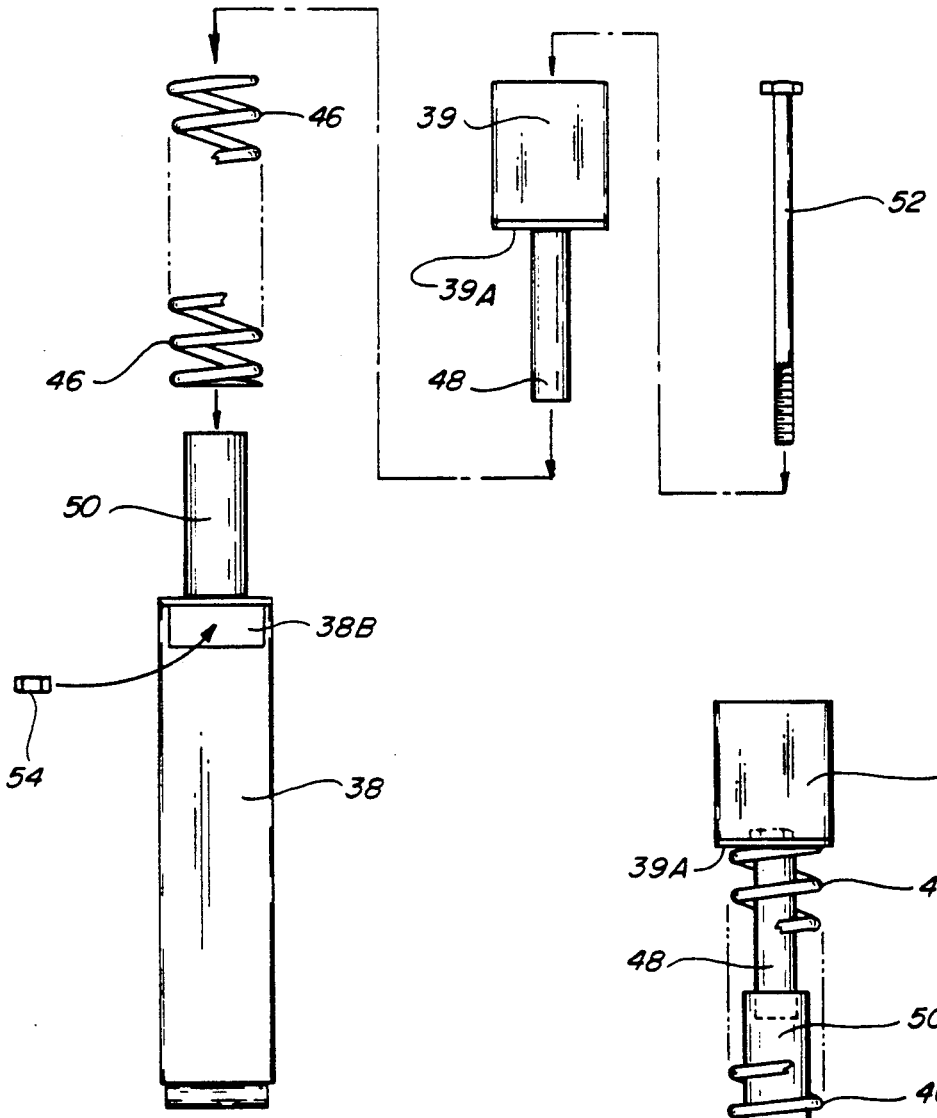

Compression spring 46 is a critical component of damping device 16 and is quickly and easily replaceable a best shown in FIG. 6. Spring 46 is made from high quality steel and must be adapted to the over all size and construction of damping device 16. When bucket 12 is a standard 8,000 pound bucket, spring 46 will generally carry a compression ratio of 3,000 to 5,000 pounds per square inch. A particularly useful spring for use with an 8,000 pound bucket is sold by Southern Marketing Affiliates of Jonesboro, Arkansas as part number 17195. This spring is characterized by a maximum load to collapse of about 4,000 pounds per square inch and the spring collapses from about 9 inches to about 6.8 inches in length when fully compressed under load of about 4,000 pounds per square inch.

Generally, damping device 16 of this invention will be used in pairs on the buckets of conventional dirt scrapers. Three or more damping devices of this invention may be used in connection with very large buckets.

Although the preferred embodiment of this invention has been described in connection with conventional towed dirt scrapers, the invention is adapted for use in any equipment where a bucket with a blade is used to pick up and transport dirt or other frangible materials. This damping device can be easily adapted to other types of scrapers and fixed blade earth movers, or practically anything that gives any type of bouncing problem, simply by changing the size of the skid shoes and load compression strength of the springs, depending on the weight and resistance pressure needed. The size of the apparatus can be changed to fit the equipment. Examples of other uses would be on the huge buckets used in connection with strip mining, the collapsible buckets used on back-hoe equipment, large blades such as those used on the front of tractors and for any other equipment where damping vibrations is desirable. The damping device of this invention could even be used in the construction of high rise buildings where damping of the massive construction elements is necessary to provide a very small amount of movement to prevent breaking up of the structure.

Thus there has been shown and described novel means for improved damping devices for dirt scrapers. The present invention fulfills all the objects and advantages set forth above. It will be apparent to those skilled in the art, however, that many changes, modifications, variations and other uses and applications for the subject invention are possible. All such changes, modifications, variations and other uses and applications which do not depart from the spirit and scope of the invention are deemed to be covered by the invention, which is limited only by the claims which follow.

I claim:

1. A damping device adapted for use on dirt buckets comprising:

a skid shoe hingedly attachable to said bucket by a front hinge at the front end of said skid shoe, said skid shoe having a wear plate rigidly attached on the bottom side of said skid shoe, said skid shoe being hingedly attachable back of said front hinge to a spring loaded leg by a rear hinge, said spring loaded leg being removably connected to an outer sleeve, said outer sleeve being rigidly attachable to said dirt bucket and essentially completely encasing said spring-loaded leg.

2. The damping device of claim 1 wherein said spring-loaded leg is comprised of a lower inner sleeve and an upper inner sleeve with a compression spring held in place between said lower inner sleeve and said upper inner sleeve.

3. The damping device of claim 2 wherein said compression spring is held in place between said lower inner sleeve and said upper inner sleeve by means of a female projection attached to said lower inner sleeve and projecting upward in mating relationship with a male projection attached to said upper inner sleeve and projecting downward in mating relationship with said female projection.

4. A damping device according to claim 2 wherein said compression spring is held in alignment between said lower inner sleeve and said upper inner sleeve by means of a bolt projecting through an opening in said lower inner sleeve and in said upper inner sleeve and threadably attached with a nut to hold said compression spring in place when extended, said bolt being adapted to move downwardly through said openings when said compression spring is compressed.

5. A damping device according to claim 1 wherein said compression spring is comprised of high grade steel.

6. The damping device of claim 5 wherein said compression spring will display a compression ratio of 3,000 to 5,000 pounds per square inch and be compressible from about 9 inches to about 6.8 inches in length when fully compressed under said load of about 3,000 to about 5,000 pounds per square inch.

7. The damping device according to claim 1 wherein said wear plate is attached to said skid shoe with bolt means.

8. The damping device according to claim 7 wherein said wear plate is tapered on the front facing end.

9. The damping device of claim 1 wherein said front hinge is welded to a bottom portion of said dirt bucket and wherein said outer sleeve is welded to a back portion of said dirt bucket.

10. The damping device of claim 1 wherein said front hinge is held together by means of a removable pin and key, wherein said rear hinge is held together by means of a removable pin and key and wherein said leg is held in place inside said outer sleeve by means of a removable pin and key, so that all component parts of said damping device may be quickly removed and disassembled for repair and replacement of parts.

* * * * *

UNITED STATES PATENT AND TRADEMARK OFFICE

CERTIFICATE OF CORRECTION

PATENT NO. : 5,307,570

DATED : May 3, 1994

INVENTOR(S) : Dennis Brown

It is certified that error appears in the above—identified patent and that said Letters Patent is hereby corrected as shown below:

Column 1, line 68, after "difficulty", insert --.--.

Column 2, line 27, "on" should be --one--.

Column 4, line 8, "t" should be --to--.

Column 4, line 12, "to" should be --top--.

Column 4, line 58, "a" should be --as--.

Signed and Sealed this

Sixteenth Day of August, 1994

Bruce Lehman

*Attest:*

BRUCE LEHMAN

*Attesting Officer*

*Commissioner of Patents and Trademarks*